United States Patent [19]

Lacinski

[11] 4,305,120

[45] Dec. 8, 1981

[54] DROP LIGHT ROTATIONAL APPARATUS

[76] Inventor: Robert J. Lacinski, 13605 Wide Acres Rd., Golden, Colo. 80401

[21] Appl. No.: 23,836

[22] Filed: Mar. 26, 1979

[51] Int. Cl.[3] ..... F21V 21/00

[52] U.S. Cl. ..... 362/396; 362/400; 362/418; 362/430; 362/344

[58] Field of Search ..... 362/382, 387, 427, 451, 362/396, 399, 400, 344, 418, 430, 378

[56] References Cited

U.S. PATENT DOCUMENTS

| | | | |
|---|---|---|---|
| 2,510,708 | 6/1950 | Marshall | 362/378 X |
| 2,608,643 | 8/1952 | Day | 362/344 |
| 2,696,551 | 12/1954 | Riga | 362/344 |
| 2,707,229 | 4/1955 | Breithaupt | 362/344 |
| 2,730,612 | 1/1956 | Westendorf | 362/376 |
| 2,745,000 | 5/1956 | Kowalcyk | 362/378 X |
| 3,808,420 | 4/1974 | Gortner | 362/396 |
| 4,128,226 | 12/1978 | Ross | 362/396 |

*Primary Examiner*—Benjamin R. Padgett
*Assistant Examiner*—J. L. Barr

[57] ABSTRACT

An apparatus for releasably securing a drop light against rotation with respect to a connector from which the drop light depends, having a housing fixedly secured to the connector and an adaptor fixedly secured to said drop light. The housing is provided with a component having serrations which mate with corresponding serrations of a component of the adaptor when said drop light depends from said connector in an unrestrained manner.

12 Claims, 5 Drawing Figures

DROP LIGHT ROTATIONAL APPARATUS

BACKGROUND OF THE INVENTION

This invention relates to drop lights, and more particularly to an apparatus for rotating a drop light to any desired fixed orientation.

Drop lights are conventionally utilized in conjunction with extension cords to provide light where such is otherwise unavailable to a working area. These drop lights are equipped with a fastening device, usually a hook, to suspend the drop light from any suitable structure in close proximity to the working area. The drop light conventionally has an electric light encased in an elongated housing having a handle depending from the lower end thereof. An electrical cord passes through the lower end of the handle to a light socket positioned at the lower end of the housing. The elongated housing is constructed of a solid reflector surface and a cage having a complementary configuration.

Precise light orientation is a significant problem in utilizing conventional drop lights. Often, the object over which the hook of a drop light is placed has a relatively unstable orientation, such as an electrical or metal wire, thereby preventing precise orientation of the drop lights. Even if the object to which the hook is secured has a fixed orientation, it may be impossible to achieve the desired orientation of the drop light since the number of positions in which the hook may be secured to the object are usually limited. It is imperative that a drop light be positioned to efficiently illuminate the working area while shading the eyes of any individual working in the area.

In an attempt to alleviate this problem, several prior art drop lights have been equipped with rotatably adjustable suspension hooks. For example, U.S. Pat. No. 2,696,551 to Riga provides a rotatable hook for a drop light which utilizes a panel attached to the hook for releasable orientation. To angularly adjust the light with respect to the hook, which is secured to a stationary object, the light guard is grasped and manually rotated with respect to the hook. During rotation, the panel rides over upwardly protruding eyes of the guard. Once the desired orientation is achieved, adjacent eyes secure the panel, and therefore the hook, in a relatively fixed position with respect to the light guard. However, since relative rotation of either the hook or guard will change the orientation of the light, this rotational hook lacks the degree of positive lock necessary to ensure against unwanted rotation of the light.

Another prior art approach utilizes a spring biased, rotatable hook in conjunction with drop lights. U.S. Pat. Nos. 2,659,810 to Fineman et al. and 2,707,229 to Breithaupt disclose drop lights equipped with spring biased hooks which are rotated by depressing the hook and rotating the same. While these hooks exhibit a positive lock, it is extremely difficult to rotate the light guard by upward manipulation thereof while the hook is secured to a stationary structure since the force necessary to overcome the force of the spring will usually unseat the hook. U.S. Pat. Nos. 2,510,708 to Marshall and 3,808,420 to Gortner disclose drop lights equipped with spring biased hooks which are rotated by either pulling the guard of the drop light downward while the hook is secured to a stationary object and rotating the same until the desired orientation thereof is achieved or by pulling the hook upwardly and rotating the same if it is desired to maintain the relative orientation of the light guard while securing the hook to a different stationary object. The bias of the spring tends to releasably secure the hook and light guard against relative rotation. As before, although these spring biased hooks provide a positive lock, several disadvantages exist. For example, when the light guard is pulled downwardly, the force necessary to overcome the force of the spring at times is sufficient to damage the object, such as wires or conduit, to which the hook is attached. Further, when the light guard is suspended at a height such that an individual can't reach the light guard or handle, an individual will often pull downwardly on the electrical cord. Such practice can result in damage to the cord, and expose the individual to the risk of electrical shock. It is extremely difficult to achieve the desired rotation of the light guard by rotating the electrical cord since rotation of the cord is not efficiently transmitted to the light guard. Also, selection of proper spring tension is extremely difficult as the weight of cord which directly depends from a drop light will vary as the light is utilized in different manners. U.S. Pat. Nos. 1,824,941 to Winder, 3,317,225 to Cooper and 3,330,594 to Cadle disclose various spring biased rotational devices, none of which overcome the problems aforedescribed.

Thus, it can be appreciated that a need exists for an improved apparatus which normally releasably secures the hook of a drop light to the light guard thereof but permits relative rotation of the hook or light guard by proper manual manipulation of the same.

BRIEF SUMMARY OF THE INVENTION

The present invention relates to an apparatus for releasably securing a drop light against relative rotation with respect to a connector from which the drop light depends. The apparatus has a housing fixedly secured to the connector and an adaptor fixedly secured to the drop light and releasably secured against relative rotation with respect to the housing. The housing is provided with an annular ring having a uniformly spaced plurality of radially extending serrations formed in one surface thereof. The adaptor is provided with a corresponding, uniformly spaced plurality of radially extending serrations. When the drop light depends from the connector, the weight of the drop light mates these serrations thereby providing a fixed orientation of the drop light with respect to the connector. These serrations may be disengaged by lowering the connector and/or raising the drop light, and hence the relative orientation changed prior to mating the serrations by allowing the drop light to depend from the connector in an unrestrained manner.

BRIEF DESCRIPTION OF THE DRAWING

The invention will be more readily umderstood by reference to the accompanying drawing wherein like reference numerals indicate like elements wherever applicable and in which.

DETAILED DESCRIPTION

Figure 1:
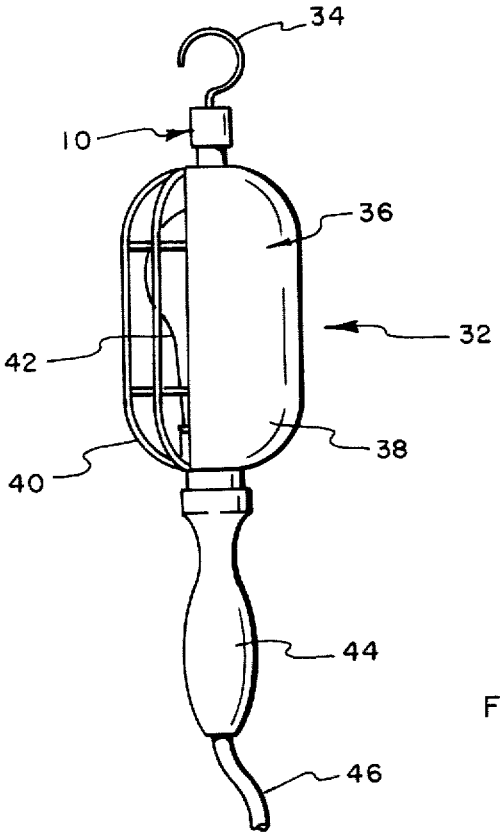
FIG. 1 is a perspective view of the rotational apparatus of the present invention assembled with a drop light.

Referring now to FIG. 1, the rotational apparatus of the present invention is illustrated generally as 10. One end of the apparatus 10 is fixedly secured to a hook 34 of a drop light 32. The opposite end of the apparatus 10 is fixedly secured to the upper end of light guard 36. Light guard 36 has a solid enlongated reflector plate 38 and a correspondingly configured wire cage 40 which is hinged to reflector plate 38 (not illustrated). Reflector plate 38 serves to direct light through the cage area thereby shading an individual's face from direct light when the drop light is properly oriented. The lower end of the light guard 36 is fixedly secured to an elongated handle 44 which is constructed of a suitable nonconductive material, such as rubber. An electric cord 46 passes through the handle and terminates in a socket (not illustrated) into which light bulb 42 is mated. The other end of cord 46 terminates in a suitable plug connector (not illustrated).

Figure 2:
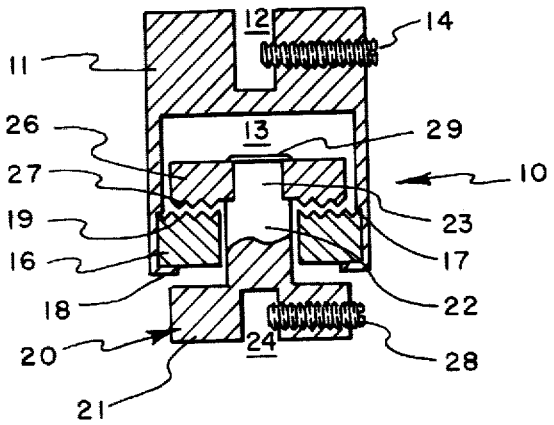
FIG. 2 is a partially cut away, cross-sectional view of the rotational apparatus of the present invention.

As shown in greater detail in FIG. 2, the rotational apparatus 10 of the present invention has a generally cylindrical housing 11. The upper end of housing 11 is provided with a concentric, generally cylindrical bore 12, while the lower end of housing 11 is provided with another concentric, generally cylindrical bore 13 having a substantially greater depth and diameter than bore 12. A set screw 14 is mated with a corresponding threaded bore in the upper end of housing 11 and, when fully mated, terminates within bore 12 thereby fixedly securing the shank of a hook positioned therein, as hereinafter described.

An adaptor 20 is integrally constructed of a lower generally cylindrical portion 21, an intermediate generally cylindrical portion 22 of reduced diameter and an upper generally cylindrical portion 23 of still further reduced diameter. The bottom end of lower portion 21 is provided with a concentric, generally cylindrical bore 24. A set screw 28 is mated with a corresponding threaded bore in lower portion 21 and, when fully mated, terminates within bore 24 thereby fixedly securing a shank which is secured to the light guard and positioned therein, as hereinafter described.

Figure 3:
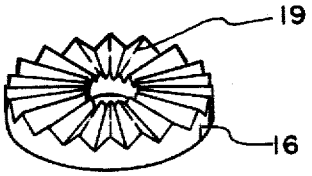
FIG. 3 is a perspective view of a serrated annular ring utilized in the rotational apparatus of the present invention.

Means for releasably securing adaptor 21 against rotation with respect to housing 11 are provided in the form of annular rings 16 and 26. Annular ring 26 is positioned over upper portion 23 of adaptor 20 and is secured against movement by the upper annular surface of intermediate portion 22 and rivet 29. Alternatively, any other suitable means of attachment, such as welds, may be utilized in lieu of rivet 29. The bottom surface of annular ring 26 is provided with uniformly spaced, radially extending serrations 27 having a constant depth. Annular ring 16 is positioned within bore 13 and held therein by means of an annular retaining ring 18 which may be formed by knurling or forcing the bottom edge of housing 11 inwardly after ring 16 has been positioned within bore 13. Alternatively, annular retaining ring 18 may be separately formed and attached to the bottom edge of housing 11 by any suitable means, such as by welds or set screws (not illustrated). Preferably, the lower end of bore 13 is countersunk to provide an annular shoulder 17 which restrains annular ring 16 against upward movement. The upper surface of annular ring 16 is provided with uniformly spaced, radially extending serrations 19 having a constant depth (as illustrated in greater detail in FIG. 3). The number of serrations 19 identically corresponds to the number of serrations 27 so as to provide for a positive uniform mate between annular rings 16 and 26. All the components of the rotational apparatus may be screw machined from cold roll steel, and preferably are zinc plated to extend the useful life thereof.

Figure 4:
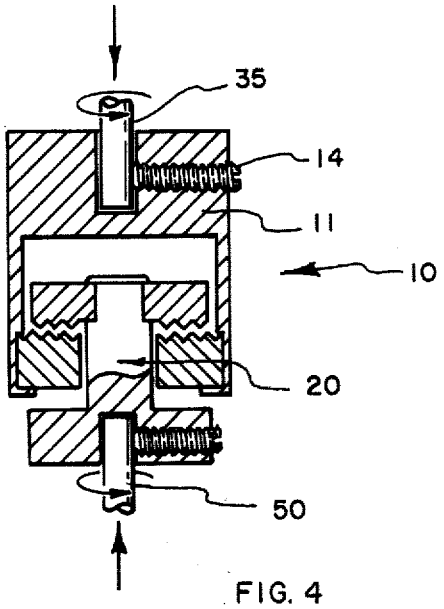
FIG. 4 is another partially cut away, cross-sectional view of the rotational apparatus of the present invention.
Figure 5:
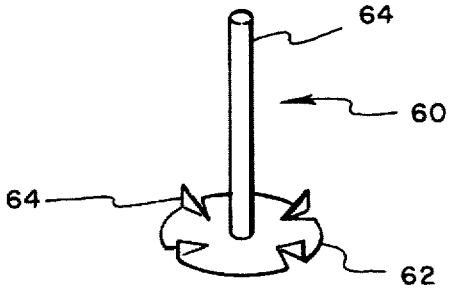
FIG. 5 is a perspective view of a connector utilized to secure the rotational apparatus of the present invention to the light guard of a plastic constructed drop light.

Referring now to FIG. 4, the rotational apparatus 10 is illustrated as having housing 11 fixedly secured to the shank 35 of hook 34 by means of set screw 14 and having adaptor 20 fixedly secured to shank 50 which is attached to light guard 36 of drop light 32. Thus, it will be appreciated that drop lights may be manufactured with the rotational apparatus of the present invention, or conventional drop lights may be retrofitted with apparatus 10. If it is desired to retrofit a metallic constructed drop light, the hook of the drop light is severed by any suitable means so as to provide a shank 50 which extends upwardly approximately ½ inch from the upper end of light guard 36. The shank 50 thus formed is fixedly secured within bore 24, as aforedescribed, and the shank of the remaining portion of the metallic hook is secured within bore 12, also as aforedescribed. However, if the drop light is constructed of plastic, utilizing the plastic hook is not desirable as the plastic is susceptible to stress failure due to fatigue. Thus, to retrofit the rotational apparatus 10 of the present invention to a plastic constructed drop light, a metallic connector illustrated in FIG. 5 generally as 60 is utilized. Connector 60 has a generally circular base 62 and an integral, concentric shank 64 upwardly extending therefrom. The base has a plurality of uniformly spaced barbs 64 extending upwardly therefrom. To retrofit a plastic constructed drop light, the plastic hook is removed from the light guard and shank 64 is inserted through the bore in the upper end of the light guard which the shank of the plastic hook was positioned through. The connector 60 is then forced upwardly until barbs 64 embed within the plastic light guard thereby fixedly securing the connector to the light guard. Subsequently, shank 64 is fixedly secured in bore 24, as aforedescribed. The shank 35 of a metallic hook 34 is secured within bore 12, also as aforedescribed.

In practice when hook 34 is secured to an object, the weight of the other components of drop light 32 will force adaptor 20 and hence annular ring 26 downwardly thereby positively mating serrations 27 and 19 which fixedly secure the orientation of light guard 36 with respect to hook 34. As such, a positive lock is provided without the use of a spring and the attendant difficulties thereof. This positive lock may be released and reset by either depressing hook 34 or raising the light guard 36, as illustrated by the arrows in FIG. 4, thereby disengaging serrations 19 and 26. Thereafter, either the hook 34 or light guard 36 is rotated to achieve the desired orientation thereof and the hook raised or light guard lowered to mate serrations 19 and 26 thereby again providing a positive lock. The rotational apparatus of the present invention may not be reset by rotating cord 46 thereby preventing damage to the cord as well as increasing safety in utilizing the drop light. Also, damage to objects which hook 34 is secured to is minimized since light guard 36 must be raised, instead of pulled, to change the orientation thereof.

While various embodiments and modifications of this invention have been described in the foregoing description, further modifications will be apparent to those skilled in the art. Such modifications are included within the scope of this invention as defined by the following claims.

I claim:

1. An apparatus for releasably securing a drop light against rotation with respect to a connector from which the drop light depends, said apparatus comprising:

a housing adapted to be fixedly secured to said connector; an adaptor adapted to be fixedly secured to said drop light; and means for releasably securing said adaptor against rotation with respect to said housing when said drop light depends from said connector in an unrestrained manner, said means being released to allow for relative rotation when said connector and said drop light are axially moved relative toward one another.

2. The apparatus of claim 1 wherein said housing is substantially cylindrical and has a first concentric, substantially cylindrical bore in the upper end thereof and a second concentric, substantially cylindrical bore in the lower end thereof, said second bore being of a substantially greater depth and diameter than said first bore.

3. The apparatus of claim 2 wherein said adaptor has a lower, generally cylindrical portion, an intermediate, generally cylindrical portion of a smaller diameter than said lower portion and an upper, generally cylindrical portion of a smaller diameter than said intermediate portion.

4. The apparatus of claim 3 wherein said securing means comprises:

a first annular ring fixedly secured to said housing and having a uniformly spaced plurality of radially extending serrations formed in one surface thereof; and a second annular ring fixedly secured to said adaptor and having a corresponding uniformly spaced plurality of radially extending serrations formed in one surface thereof and mated with the plurality of serrations formed in said first ring thereby providing a positive, releasable lock against rotation between said housing and said adaptor.

5. The apparatus of claim 4 wherein said second cylindrical bore in the lower end of said housing is countersunk thereby defining an annular shoulder.

6. The apparatus of claim 5 wherein said first annular ring is positioned within said second cylindrical bore and is fixedly secured to said housing by said annular shoulder and the lower end of said housing, said lower end being knurled along substantially the entire periphery thereof.

7. The apparatus of claim 6 wherein said second annular ring is fixedly secured to said adaptor by a rivet which forces said second annular ring to abut against said intermediate portion.

8. The apparatus of claim 7 wherein said connector is a hook having a shank, said shank being fixedly secured within said first bore in the upper end of said housing by a set screw.

9. The apparatus of claim 8 wherein a second shank secured to said drop light is further fixedly secured within a concentric, substantially cylindrical bore in the lower portion of said adaptor by a set screw.

10. The apparatus of claim 9 wherein said drop light is constructed of plastic and said second shank is integrally connected to a base having a plurality of barbs extending upwardly therefrom and embedded in said plastic drop light.

11. An apparatus for releasably securing a drop light against rotation with respect to a connector from which the drop light depends, said apparatus comprising:

a housing adapted to be fixedly secured to said connector;

an adaptor adapted to be fixedly secured to said drop light; an annular ring fixedly secured to said housing and having a uniformly spaced plurality of radially extending serrations formed in one surface thereof; and means for mating with said serrations to releasably secure said adaptor against rotation with respect to said housing when said drop light depends from said connector in an unrestrained manner, said means permitting relative rotation between said connector and said drop light when said connector and said drop light are axially moved relative toward one another.

12. A combination of a drop light and a connector from which the drop light depends, the drop light being releasably secured against rotation with respect to the connector, the combination comprising:

a drop light having a light guard and an elongated handle;

a connector having a hook and a shank integral therewith;

a housing fixedly secured to the shank of said connector;

an adaptor fixedly secured to said light guard; and means for releasably securing said adaptor against rotation with respect to said housing when said drop light depends from said connector in an unrestrained manner, said means being released to allow for relative rotation when said connector and said drop light are axially moved relative toward one another.

* * * * *